US005529241A

United States Patent [19]

Roder

[11] Patent Number: 5,529,241

[45] Date of Patent: Jun. 25, 1996

[54] MODEL RAILWAY TRACK AND METHOD OF ASSEMBLING IT

[76] Inventor: Donald J. Roder, R.D. #1, Box 255-A, North Rose, N.Y. 14516

[21] Appl. No.: 302,030

[22] Filed: Sep. 9, 1994

[51] Int. Cl.[6] ..... E01B 23/00

[52] U.S. Cl. ..... 238/10 E; 238/15

[58] Field of Search ..... 238/10 R, 10 A, 238/10 C, 10 E, 10 F, 15, 24, 84, 264; 72/457

[56] References Cited

U.S. PATENT DOCUMENTS

| | | | |
|---|---|---|---|
| 1,701,947 | 2/1929 | Caruso | 238/10 E |
| 1,949,720 | 3/1934 | Kelley | 238/10 E |
| 2,120,251 | 6/1938 | Johnson | 238/10 R |
| 2,290,584 | 7/1942 | Gardner et al. | 238/10 E |
| 2,351,279 | 6/1944 | Matter | 72/457 |
| 2,405,533 | 8/1946 | Varney | 238/10 R |
| 2,565,359 | 8/1951 | Dubilier | 238/10 R |
| 2,665,849 | 1/1954 | Smith | 238/10 E |
| 2,703,204 | 3/1955 | Miller | 238/10 E |
| 2,811,315 | 10/1957 | Hirtenstein | 238/10 R |
| 3,074,647 | 1/1963 | Bonanno | 238/10 E |
| 3,223,327 | 12/1965 | Opfermann | 238/10 R |
| 4,260,104 | 5/1981 | Schaffan | 238/10 E |
| 5,370,308 | 12/1994 | Black | 238/10 E |

*Primary Examiner*—Robert J. Oberleitner
*Assistant Examiner*—S. Joseph Morano

[57] ABSTRACT

An improved rail and crosstie trackage assembly for toy trains that includes three rails slidingly fastened to a series of ties the underside of which have slots to receive two elongated reinforcing rods which are fastened thereto by bonding first one rod thereto, bending the assembly to a desired curvature and then bonding the other rod thereto in the slots.

13 Claims, 3 Drawing Sheets

MODEL RAILWAY TRACK AND METHOD OF ASSEMBLING IT

The present invention relates to model railroads and includes a new and improved track and method of assembling the same.

The invention provides an improved rail and crosstie assembly that is simple, accurately scaled for the size models to use it, and provides a smooth functioning track operationally as well as being aesthetically pleasing to the operator and viewer. The invention provides for preshaping the track to desired configurations during the assembly thereof.

Presently, tracks for model trains are made in several ways. A track similar to the instant invention is disclosed in U.S. Pat. No. 2,290,584 to Gardner et al. In that patent, a three-rail track system is shown as an assembly of wooden ties (10) to which are attached the three rails (1, 2 and 3) through outwardly biased flanges (9) fitting into transverse grooves (11). The system is described as being able to flex the assembly to a variety of purposes. In point of fact, the assembly cannot be readily bent into a smooth geometrically sound curve due to inability of a user to apply pressure equally along the entire length of the rails, whether there be two or three, to produce a satisfactory curve.

Geometrically correct curves are necessary for model railroading to enable the flanged wheels on the engines and cars to "track" correctly. This is important because sudden lateral thrust vectors on engines and cars can force them to uncouple and, in some instances, to derail. Not only do minor ripples in the rail curvature cause such lateral thrust but, due to variations in the space between the two outside rails, such ripples cause a vertical thrust on the cars due to the slope of the wheel flange allowing for a lowering of the car or engine when passing over a track where the rails are more widely separated.

Typically, attempts at bending such a track, usually supplied in three-foot or longer lengths, results in a curve with a series of bend areas with curvature radii changing abruptly. Such a track not only causes poor train operation, but is displeasing to the eye. The purchaser of such track cannot accurately bend a specific radius curve.

A track arrangement somewhat similar to the Gardner et al disclosure is shown in Kelley, U.S. Pat. No. 1,949,720. Such an arrangement is inherently unstable and attempts at bending will result in even worse configurations than previously described.

Both Gardner et al and Kelley were attempts to make trackage available for model railroading that would appear realistic, a desirable characteristic in trackage. The traditional alternative has been short length curved and straight track sections. Such trackage type is shown in U. S. Pat. Nos. 1,701,947 and 3,074,647, which show two types of track produced by Lionel Corporation known as "0" gauge track and "Super 0" track, respectively.

The problems with the Lionel track and others similar to it are the expense and non-prototypical look. Typically, the ties are made of pressed or stamped metal pieces which are widely spaced from one another and the straight and curved sections are relatively short, usually twelve inches long, thus necessitating connecting a large number of sections together to provide a curved assembly. U.S. Pat. No. 2,665,849 shows a similar track and centers on an attempt to make it appear more realistic. The track shown was produced by the A. C. Gilbert Company after it had acquired the "American Flyer" line and was known as "S" gauge. Additionally, trackage such as this is far more expensive to manufacture than the Gardner et al trackage.

Other attempts to make a realistic track which could be bent to simulate real railroad curves are illustrated and shown by Dubilier, U.S. Pat. No. 2,565,359 and Johnson, U.S. Pat. No. 2,120,251. While these systems are readily bendable, they are not realistic in appearance and were never manufactured. Additionally, the two designs would be prohibitively expensive to manufacture.

Further attempt to build accurately curved track at a reasonable price is shown by Schaffan, U.S. Pat. No. 4,260,104.

The instant invention is designed to overcome the above-recited problems and provide an improved trackage assembly and a method of accurately curving said track.

It is also an object of this invention to provide an aesthetically pleasing trackage assembly.

A further object of this invention is to provide a realistically configured trackage assembly.

A still further object of this invention is to provide a strengthened trackage assembly in substantial lengths.

Another object of this invention is a method of providing accurately curved trackage for model railroading.

Yet another object of this invention is to provide accurately curved model railroad track sections in substantial lengths.

An additional object of this invention is to provide an improved track structure which is simple in design, rugged in construction and economical in manufacture.

These and other objects will become apparent when reference is had to the accompanying drawings in which FIG. 1 is a perspective view of a tie comprising part of the instant invention;

Figure 1:
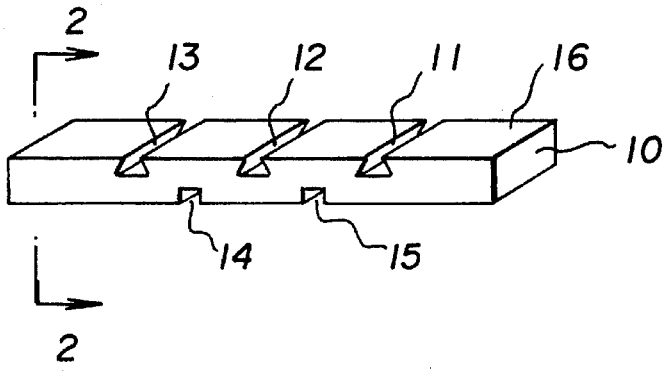
Figure 2:
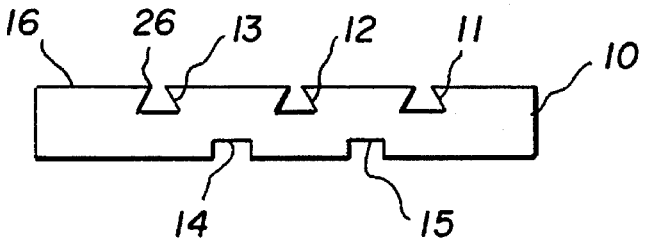
FIG. 2 is a cross-section of FIG. 1 taken along sectional line 2—2.

Referring in detail to the drawings, FIG. 1 shows a perspective view of the tie used to form this invention. Tie 10 is made of a high-impact plastic, preferably polystyrene or other suitable non-conductive material and is generally rectangular with an upper surface having either two or three transverse grooves such as 11, 12 and 13 cut therein. The grooves are shaped like transverse dovetail mortises. They have side walls which diverge as the progress downward. At their intersection with surface 16, they can be chamfered as at 26 to allow for "springing" the rails into the grooves. FIG. 2 shows the cross-section of the tie 10 and, as does FIG. 1, shows the bracing slots 14 and 15 which generally define a rectangular or square slot.

Figure 3:
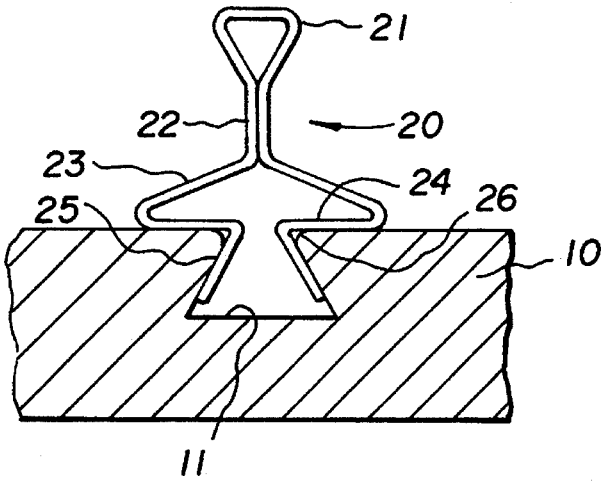
FIG. 3 is a cross-section view of a section of a tie and accompanying rail section showing the relationship between the two.
Figure 6:
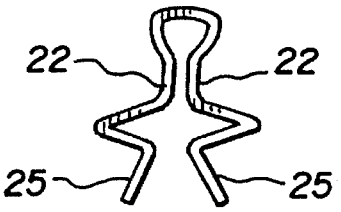
FIG. 6 shows the rail cross-section prior to being assembled.

FIG. 3 shows a cross-section of a typical rail 20 used in the assembly. Rails 20 are made of a sheet metal stock which are formed, in a continuous fashion, into the configuration shown in FIG. 3. The rail is slightly flattened at the top at 21, has downwardly extending webs such as 22, flares outwardly to provide flanges 23 to simulate real full-size rail, is bent back inwardly as at 24 and then downwardly as at 25 to provide flared anchoring extensions. These extensions lock the rail into the grooves by pressing against the sides thereof. Rail 20 is shaped so that it initially looks like the shape shown in FIG. 6. It is pressed together to lock into the grooves by the web portions (22) abutting and extensions (25) pressing against the walls of the groove. The base of the grooves are flat as at 11 to allow the extensions to be placed within the groove and spring outwardly to lock the rail to the tie. The top of the grooves can be chamfered as at 26 to ease insertion of the rails into the grooves, but this is not an absolute requirement. Again, the pressure of the extensions against the sides of the grooves help to lock it into place.

Figure 4:
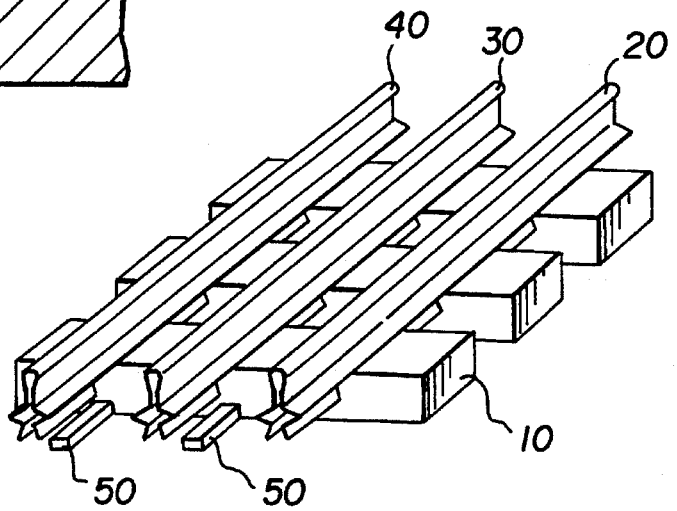
FIG. 4 is a perspective view of the improved rail assembly constituting this invention.

The rails, once in place, look prototypical as in real railway and don't have the "tinplate" toy look that other commercially available model railroad track does. FIG. 4 shows the assembled rail structure in perspective and the two bracing members, 50, 51 generally rectangular or square in cross-section, which fit into bracing slots 14, 15 in each tie. Bracing or reinforcing members 50 and 51 are made of plastic or other suitable material.

Figure 5:
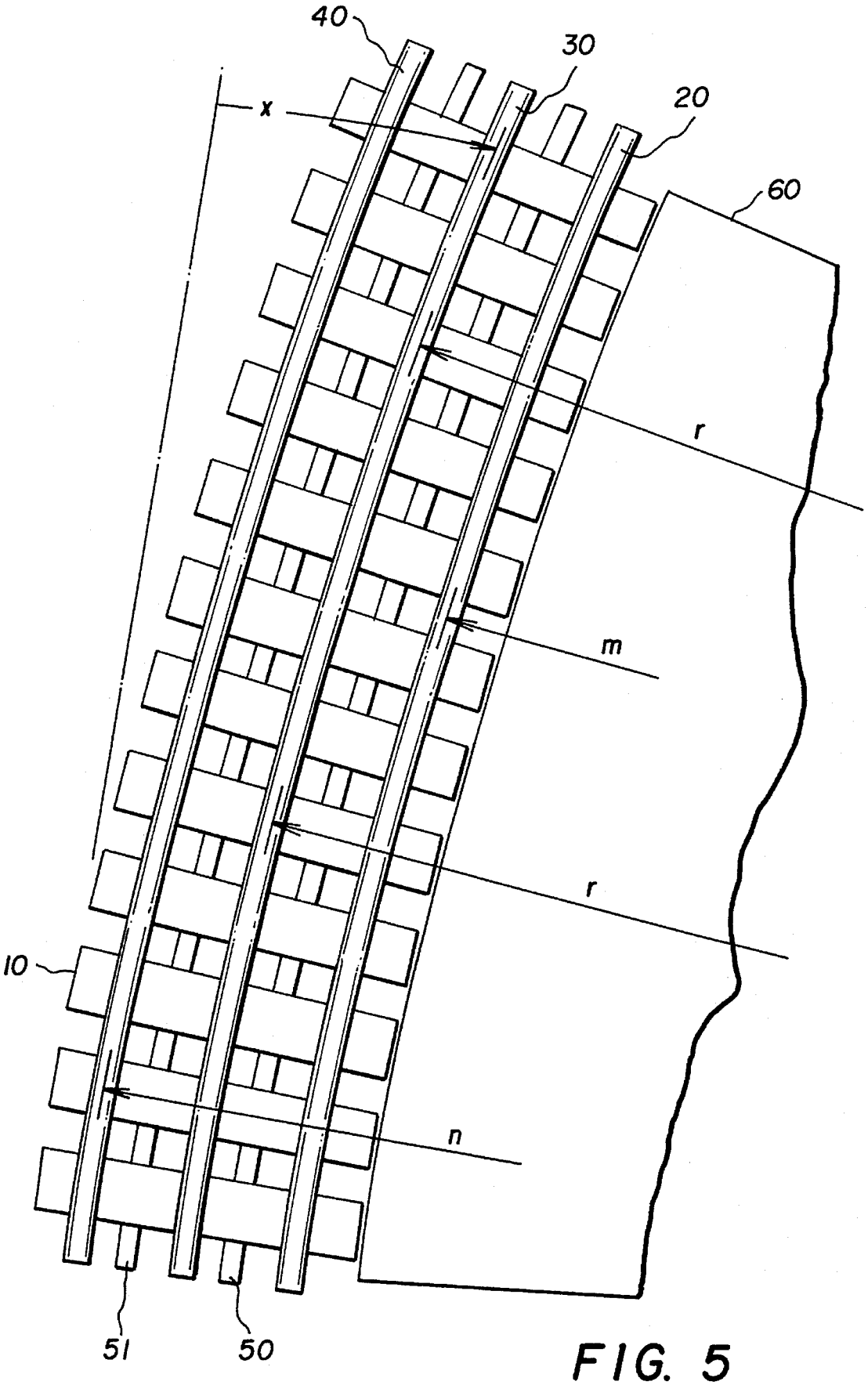
FIG. 5 is a plan view of the rail assembly constituting this invention showing the trackage being bent to a predetermined curve.

The bracing members are generally of the same cross-sectional area of the slots 14, 15 so as to fit snugly therein. FIG. 5 shows a section of the track constituting this invention being shaped into a desired curvature in a predetermined accurate manner. The track is shown in plan view being pressed laterally against shaping block 60 whereby the ends of ties 10 abut the shaping edge 61 of block 60. As the block is configured to an exact desired curvature, such as 15°, 22°, 30°, etc. for the track there is uniformity in the bending of the rails, thereby eliminating the problems of ripples, non-uniform bending, and uneven "gauging", i.e., having the distance between the outer rails vary if even slightly.

FIG. 5 shows rails 20, 30 and 40 being bent to the right to produce a desired change of direction x to the track. The radii of the bend of rails 20, 30 and 40, namely m, r and n, respectively are the same and importantly the centerpoint of the bend is the same throughout its length. Thus the rails are bent uniformly, no rippling or unwanted compound bends are occasioned and the track is formed in a smooth aesthetic fashion.

Once the desired configuration is obtained, the bracing member 50, already placed in the slot 15, is bonded to the ties so as to bend with the track. Again, bracing member 50 is placed in slot 15 and bonded to ties by epoxy, glue or other suitable bonding agent.

Figure 7:
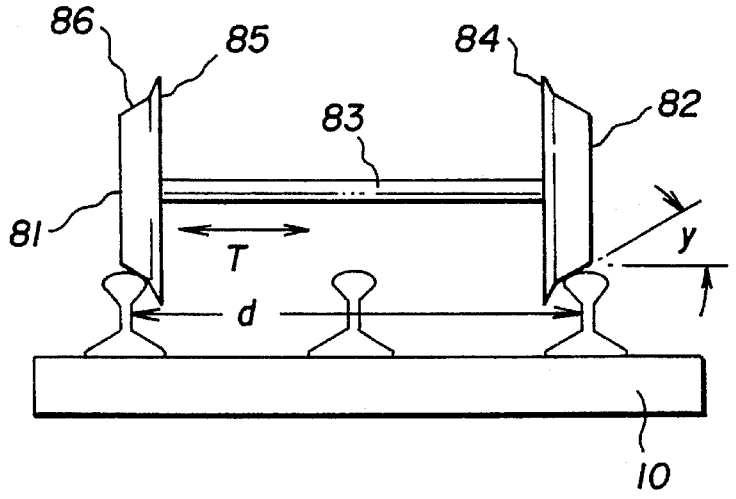
FIG. 7 shows car wheels on a track of this invention.

The tracks are now in a configuration for use inasmuch as the rolling stock, the engines and cars, will roll smoothly on the rails as shown in FIG. 7. Wheels 81, 82 on axle 83 have flanges 84, 85 and are beveled as at 86. As the distance d between the outside rails (the middle rail is used for conducting electric power) increases, the axle sinks lower due to the angle y of the beveled flanged wheels. Additionally, as ripples or compound angles in the rail curvature occur, a lateral thrust T is caused. The lateral thrust causes the cars to vibrate and uncouple and, if severe enough, to derail, especially when running at high speed. The trackage may be bent to any desired curvature using the method described herein as the invention. A 10, 45 or even 60 degree angle may be provided in a length of trackage. If a 90 degree turn is desired, it can be provided in one, two or three lengths, depending on the degree of curvature. In fact, even a 180 degree reverse turn can be provided if desired. The bracing members provide additional strength to the crossties and bracing members and the shape of the slots and members.

Figure 8:
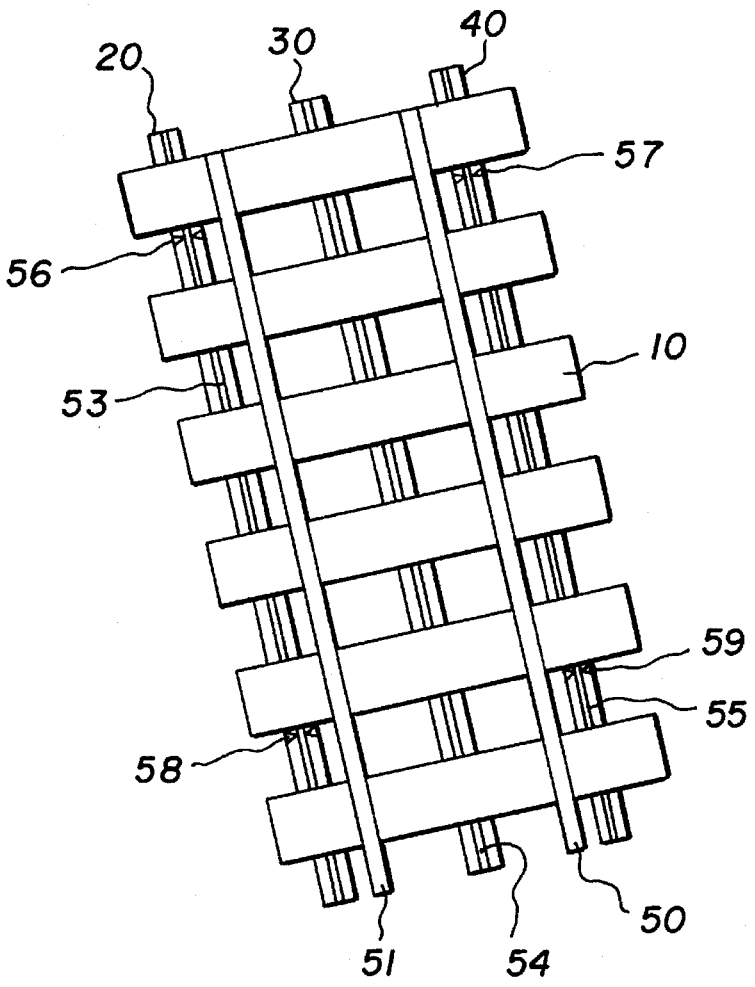
FIG. 8 shows the underside of a track section.

FIG. 8 shows the underside of a track built according to this invention. It shows rails 20, 30 and 40 supported on ties 10 and bracing members 51 and 50 bonded to the ties 10 to lock it into place. To insure that the rails 20 and 40 don't slip in the slots a crimp may be placed in the flanges of the rails such as at 56 and 57. Additional crimps such as those shown at 58 and 59 may be made every 5 or 6 ties to add additional assurance against slippage. This prevents rail "creep" when handling the track and insures perfect alignment between the ends thereof. This rigid preformed trackage may be used outdoors as well as inside as the plastic ties are not affected by the weather nor are the treated metal rails.

Having described the invention it will be obvious to those of ordinary skill in the an that many changes and modifications can be made without departing from the scope of the appended claims which follow:

I claim:

1. An improved model railway trackage assembly comprising at least two preformed rail means parallel to and spaced from one another, a plurality of crosstie means attached to said parallel rail means, said crosstie means being spaced equidistantly along said rail means with spaces therebetween, said crosstie means having slot means on the underside thereof, and elongated bracing member means bonded in each said slot means to reinforce and lock said trackage assembly in a predetermined position.

2. An assembly as in claim 1 wherein said slot means are rectangular and said bracing member means are rectangular and fit tightly in said slot means.

3. An assembly as in claim 2 wherein said slot means comprising two spaced series of slots in the base of said crosstie means and a said bracing member means is filled within each series of spaced slots in said crossties.

4. An assembly as in claim 1 wherein each said preformed rail means comprises an elongated rail embodying in a folded metal construction a load-bearing portion, a web portion extending downwardly therefrom and having laterally shouldered doubled portions engaging the top faces of the crosstie means and divergent anchoring portions depending therefrom, multiple means dovetail slot means on the top of said crosstie means, said divergent anchoring portions anchoring said rail in said crosstie means.

5. An assembly as in claim 4 wherein said elongated bracing member means and said slot means are of rectangular configuration.

6. An assembly as in claim 5 wherein said bracing members and said crosstie means are of high impact plastic.

7. An assembly as in claim 1 wherein said crosstie means are made of plastic.

8. The method of applying curvature to a trackage assembly wherein the crossties are securely but slidingly mounted to the rails, the process comprising selecting the desired track curvature, providing a pattern with the desired track curvature, positioning said trackage adjacent said pattern, bending said trackage against said pattern to obtain the desired curvature thereof, securing said trackage in the bend position by bonding rectangular bracing members in slots in the crossties of said trackage.

9. An improved toy train track assembly comprising a plurality of generally rectangular crosstie members each crosstie member having spaced dovetail slots in the upper surface thereof, a plurality of elongated spaced and parallel rails slidingly affixed in said spaced dovetail slots to provide a railway for rolling stock, a series of spaced notch means on the underside of said crosstie members, and elongated reinforcing rods bonded in said series of spaced notch means thereby securing said track assembly in a desired configuration.

10. An assembly as in claim 9 wherein said crosstie members are plastic.

11. An assembly as in claim 10 wherein said notch means are rectangular slots and said elongated reinforcing rods are rectangular and fit snugly in said slots.

12. An assembly as in claim 11 wherein said reinforcing rods are plastic and bonded to each crosstie member.

13. An assembly as in claim 11 wherein at least one of said rails is crimped so as to secure the rail againist slippage in said slots.

* * * * *